United States Patent [19]

Kinsman et al.

[11] Patent Number: 4,561,745

[45] Date of Patent: Dec. 31, 1985

[54] METHOD AND APPARATUS FOR PROCESSING BOTH SIDES OF DISCRETE SHEETS

[75] Inventors: Gordon F. Kinsman, Billerica; Ronald F. Lambert, Wayland; David A. Morrison, Framingham, all of Mass.

[73] Assignee: Polaroid Corporation, Cambridge, Mass.

[21] Appl. No.: 566,313

[22] Filed: Dec. 28, 1983

[51] Int. Cl.[4] ..... G03D 5/06

[52] U.S. Cl. ..... 354/299; 354/303; 430/354

[58] Field of Search ..... 354/83, 84, 85, 86, 354/87, 88, 299, 301, 303, 304, 305, 318; 430/354, 355, 404

[56] References Cited

U.S. PATENT DOCUMENTS

| | | | |
|---|---|---|---|
| 2,435,718 | 2/1948 | Land | 354/304 |
| 2,520,641 | 8/1950 | Land | 354/303 |
| 2,605,684 | 8/1952 | Nagels et al. | 354/318 |
| 2,719,789 | 10/1955 | Land | 354/86 |
| 2,778,734 | 1/1957 | Fairbank | 354/86 |
| 3,345,172 | 10/1967 | Land | 430/354 |
| 3,363,530 | 1/1968 | Rice | 354/318 |
| 3,640,204 | 2/1972 | Gordon | 354/318 |
| 4,370,045 | 1/1983 | Holmes | 354/304 |

*Primary Examiner*—A. A. Mathews

*Attorney, Agent, or Firm*—David R. Thornton

[57] ABSTRACT

A method and apparatus for simultaneously processing both sides of a film sheet include a pair of carrier webs extending through a nip defining mechanism and a dispenser for depositing a bead of the processing material on the carrier webs in the nip. The carrier webs are advanced through the nip by a distance greater than the length of the film sheet to be processed in order to spread the processing material, and then retracted and separated. The film sheet is fed to between the carrier webs at those areas which are covered with processing material. The carrier webs with the film sheet between them are advanced through a gap of predetermined width to press the processing material on the carrier webs into contact with the film sheet, thereby forming a sandwich. The film sheet remains in the sandwich for a suitable imbibition time, after which the film sheet is delivered. In one embodiment, the processing material takes the form of a frozen body which is deposited onto the carrier webs and melted.

13 Claims, 5 Drawing Figures

METHOD AND APPARATUS FOR PROCESSING BOTH SIDES OF DISCRETE SHEETS

BACKGROUND OF THE INVENTION

This invention relates to photographic film processing and, more particularly, to a method and apparatus for rapid access processing of both sides of discrete components of photographic films.

The term "rapid access", as used herein and in the appended claims, is intended to delineate a type of photographic film or film processing which is capable of providing an image on a substrate when has been exposed directly to light defining the image or to which an image is transferred from another image or image facsimile bearing medium, by application of a processing fluid layer over the area of the image to be provided. The most common form of rapid access film processing is the diffusion transfer process used in the field of instant photography, and in which a processing fluid is spread over the surface of a sheet or web carried exposed photosensitive emulsion so that the unexposed grains of silver halide in the emulsion layer are transferred to a positive image receiving layer or layer interface.

Sheet-form films currently in use in instant photography are in the nature of preassembled film units in which each unit contains a pod of processing fluid to be distributed completely over the area of photochemicals sandwiched between two sheets of the assembly as the exposed unit is passed to the pressure nip between a pressure roller pair or equivalent. Because of the costs incident to assembling such units during manufacture, interest has arisen recently in providing rapid access films in discrete component form for appropriate exposure and processing procedures. In this latter connection, rapid access film sheets have been developed for use in recording x-ray images, for example, where a transparent substrate having photochemical layers on opposite sides is exposed to provide complementing images on opposite sides of the substrate upon exposure and processing.

The problems incident to processing such a film sheet by the application of processing fluid to opposite sides thereof are manifold. For example, some provision must be made for handling the sheet during the application of processing fluid on opposite sides as well as retaining the sheet over an adequate imbibition time for the processing fluid to interact with the photochemical layers on opposite sides of the sheet. An additional problem is presented where the nature of the exposed double-sided film sheet, coated on opposite sides with the processing fluid, requires a relatively air-tight environment for the imbibition time. In this latter respect, some types of rapid access films become sensitive to oxidation after the processing fluid is applied. Further problems involve the handling of the processing fluid where there are no preassembled film units, and the trouble and expense of providing pods or other containers for the processing fluid.

SUMMARY OF THE INVENTION

In accordance with the present invention, a method and apparatus is provided by which rapid access sheet films and chemicals may be handled for simultaneously processing both sides of the film.

In general, the invention is practiced by providing a pair of carrier webs extending from source spools over and vertically through a pair of pinch rollers and past a pair of processing rollers and a pair of turn guides to take-up spools, and a dispenser for depositing a processing material or chemical, such as a viscous reagent, on the carrier webs. A single bead of the processing chemical is placed on the facing surfaces of the carrier webs adjacent the nip formed by the pinch rollers. The carrier webs are advanced down through the pinch rollers so that the processing chemical is spread over the facing surfaces. The webs are then retracted past the pinch rollers, so that portions of the web having a coating of the processing chemical are sepa- rated.

The pair of processing rollers, which are provided adjacent the pinch rollers, define a predetermined gap chosen to accommodate a film sheet sandwiched between the carrier webs. After the processing chemical has been spread over the carrier webs, and the carrier webs have been retracted, the pinch rollers are moved apart to an inoperative position, so that the processing rollers may effect the processing of the film sheet. A leading edge of the film sheet to be processed is then moved into the gap defined between the carrier webs at the processing rollers, and the carrier webs are fed past the processing rollers with the film sheet sandwiched between the carrier webs and in engagement on both sides with the processing chemical. The film sheet remains in the sandwich, positioned between the processing rollers and the turn guides for a suitable imbibition time.

After the suitable imbibition time, the carrier webs are advanced around a turn, and the processed film sheet is freed for delivery from the apparatus.

In keeping with the object of the present invention to handle the processing fluid without the trouble and expense of pods or other containers, the processing fluid is frozen. A preferred dispenser for the frozen processing material includes a magazine containing a plurality of rod-like bodies of the frozen processing material. A frozen body is deposited onto one of the carrier webs and heated to define a bead adjacent the nip.

Thus, by the method and apparatus according to the present invention, exposed film sheets are processed and delivered in unassembled form, thereby avoiding the cost of assembly and the litter resulting from peeling the film sheet from an assembly, where such a peel-away feature is provided. Even the need for pods to contain the processing fluid is eliminated.

No handling of processing chemicals is involved. Even the processing hardware of the apparatus is spared from contact with the chemicals. Only the carrier webs, which are inexpensive and disposable, contact the processing chemicals, and, where the process is not particularly oxidation sensitive, the carrier webs are made of a material which absorbs excess chemicals so that the chemicals do not contact any other parts of the apparatus. Fresh portions of the carrier webs and a fresh bead of processing chemical are used with each film sheet to be processed, so that there is no problem of contamination or developer exhaustion.

Where the process is oxidation sensitive, the carrier webs are made of a material which protects oxidation sensitive film sheets from oxidation during the imbibition time in the sandwich, and to which the processing material clings. The continuity of the carrier webs permits the length of the sandwich to be adjusted readily to accommodate film sheets of varying length. In addition, the excess width of the carrier webs provided to absorb or adhere to excess processing chemical allows the apparatus to accommodate film sheets of varying widths. Furthermore, the predetermined gap defined by the processor rollers can be adjusted to accommodate film sheets of different thicknesses.

It can be appreciated that the method and apparatus according to the present invention is suitable for any film capable of bath processing where both surfaces of the film are contacted at the same time.

The method and apparatus according to the present invention lend themselves to processing one film sheet at a time on demand, with repeatable starts and stops, as well as to continuous processing. The method and apparatus are also well suited for control by an automatic control system operable with push buttons and for containment within a housing, so as to operate with an ease and simplicity much like that of an office photo- copier.

DETAILED DESCRIPTION OF THE PREFERRED EMBODIMENTS

Figure 1:
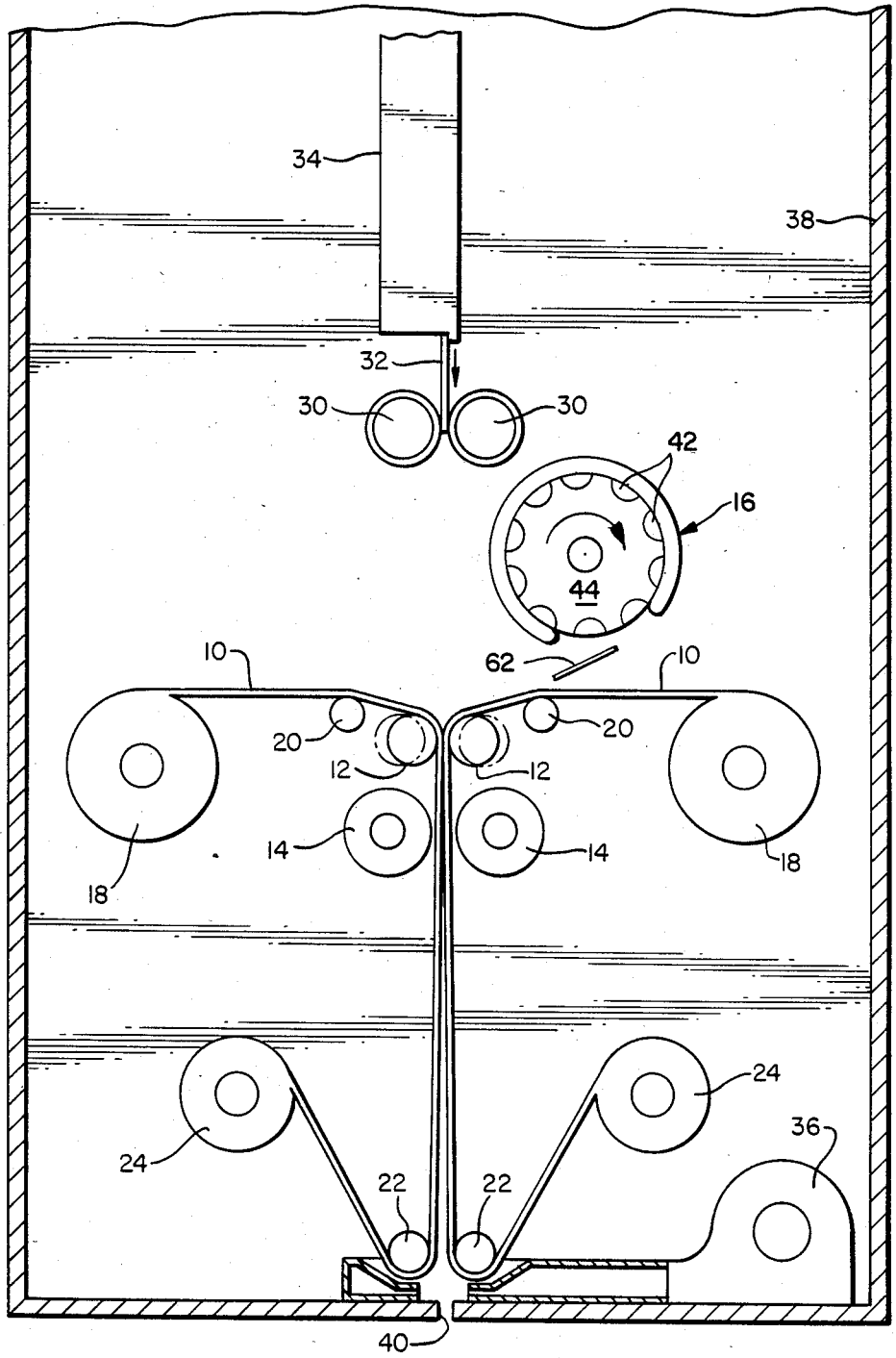
FIG. 1 is a schematic front view of the apparatus according the present invention, shown with peripheral equipment, including a portion of a housing shown in cross-section.

In FIG. 1 of the drawings, the processing apparatus of the present invention is represented generally and schematically as including a pair of carrier webs 10, a nip defining mechanism such as a pair of pinch rollers 12, a gap defining mechanism such as a pair of pregapped processing rollers 14, and a processing chemical dispenser 16 which will be described in more detail hereinafter.

In the embodiment depicted in FIG. 1, each carrier web 10 extends from a source spool 18, over a support element 20, and around a portion of one of the pinch rollers 12, with which the carrier web 10 is associated, so that both carrier webs 10 pass vertically through a nip, defined by the pinch rollers 12, having a predetermined width. Each carrier web 10 extends beyond its associated pinch roller 12, through a gap of predetermined width defined between the processing rollers 14, and around a turn guide 22 to a take-up spool 24. A pair of sheet feeding rollers 30 advances individual sheets 32 of film to be processed from a magazine or cassette 34. A drier 36 directs a stream of warm air onto the sheets 32 of film adjacent the turn guides 22 after the sheets 32 have been processed. A housing 38 encloses all of the elements described, the housing 38 including an opening 40 through which the processed film sheets 32 are delivered.

Figure 2:
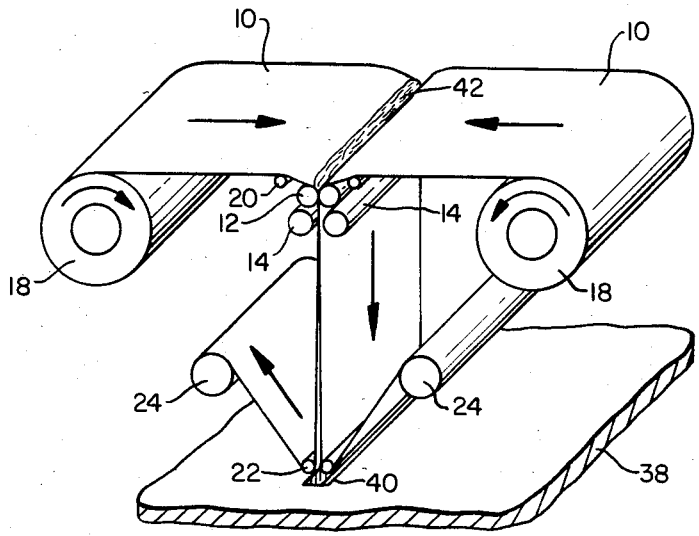
FIG. 2 is a schematic perspective view of the apparatus of FIG. 1 in a position for spreading a processing chemical on carrier webs.

In FIG. 2 of the drawings, the apparatus according to the present invention is shown in a position for applying a processing chemical 42, such as a viscous reagent, to the carrier webs 10. The dispenser 16 deposits the processing chemical 42 on one of the carrier webs 10 to define a bead in the nip defined by the pinch rollers 12. When the bead of processing chemical 42 has been formed, the carrier webs 10 are advanced past the pinch rollers 12 so that the processing chemical 42 is spread evenly across the carrier webs. The carrier webs 10 are moved past the pinch rollers 12 by a distance greater than the length of the film sheet to be processed. Furthermore, the carrier webs 10 are wider than the film sheet 32 to be processed, so that the processing chemical can be spread over an area on each carrier web 10 which is greater than the area of one side of the film sheet.

Figure 3:
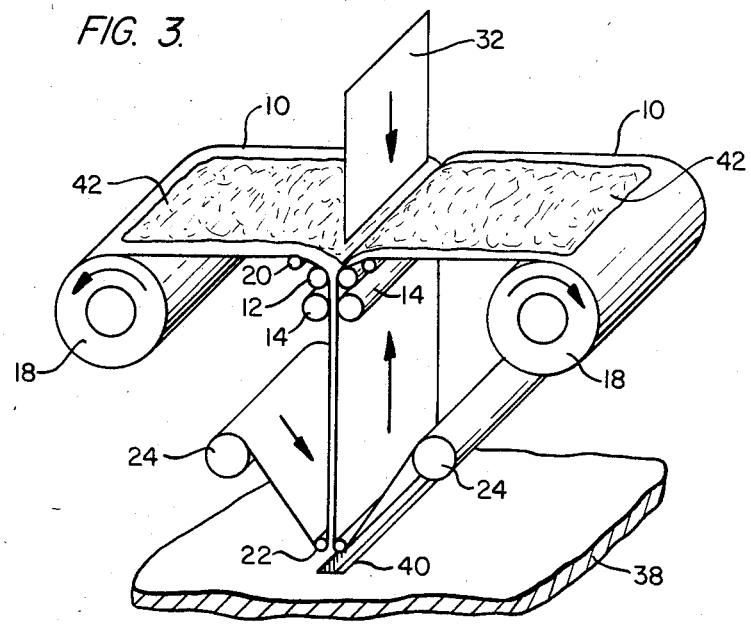
FIG. 3 is a schematic perspective view of the apparatus of FIG. 1 in a position for receiving a film sheet between the carrier webs.

In FIG. 3 of the drawings, the apparatus according to the present invention is shown in a position for receiving the film sheet 32 to be processed. The bead of processing chemical 42 has been spread evenly onto the carrier webs 10 by the process described in connection with FIG. 2, and the carrier webs 10 have been rewound on the source spools 18 to the point where the coating of processing chemical 42 formed on each carrier web 10 is exposed. It should be noted that the pinch rollers 12 are movable between an operative position in which they are effective in spreading the processing chemical 42, as shown in FIG. 2 and by the solid lines in FIG. 1, and an inoperative position in which they are spaced farther apart, so that the processing rollers 14 control the spacing between the carrier webs 10, as shown in FIG. 3 and by the phantom lines in FIG. 1. The film sheet 32 to be processed is fed so that its leading edge is positioned between the carrier webs 10 just short of the leading edges of the areas which have been coated with the processing chemical 42, and the carrier webs 10 are advanced so that the coated portions of the carrier webs and the film sheet 32 pass through the gap between the processing rollers 14. The gap is the result of supporting the processing rollers 14 on preestablished and relatively fixed axes, although the gap is adjustable to accommodate different thicknesses of carrier webs and film sheets. The gap is selected to provide the optimum thickness of processing chemical layers on the surfaces of the film sheets for the particular processing chemical and type of film sheet involved.

The turn guides 22 are spaced apart by a distance approximately equal to the width of the gap, and are spaced from the processing rollers 14 by a distance greater than the length of the film sheet 32 to be processed, thereby defining a run of the carrier webs 10 having an area greater than the area of film sheet 32 in which the carrier webs 10 are closely spaced. Thus, when the film sheet 32 is advanced past the processing rollers 14 to a position between the processing rollers and the guides 22, it is sandwiched between the coated portions of the carrier webs 10, where it remains for a suitable period of imbibition. Since the coated areas of the carrier webs 10 are greater than the area of the film sheet 32, there is an excess of processing chemical. For this reason, the carrier webs 10 are made of a material, such as porous paper, which absorbs the processing chemicals. Where the film processing is expecially sensitive to oxidation, a substantially nonporous, smooth surface carrier web to which the processing chemical clings is preferred. Such materials as polystyrene, PVC and triacetate can be used.

Figure 4:
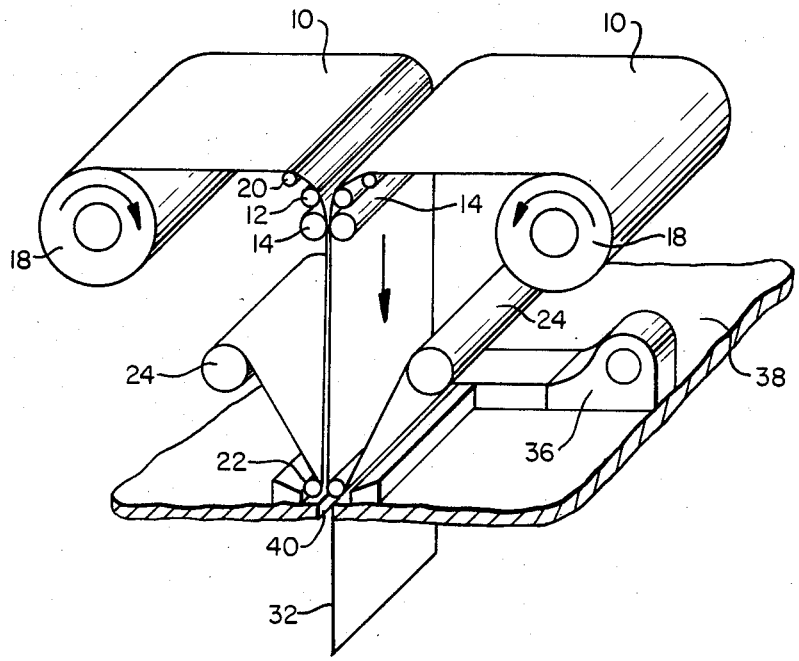
FIG. 4 schematic perspective view of the apparatus of FIG. 1 in a position for delivering the film sheet after processing.

After the imbibition period, the carrier webs 10 are advanced farther and separated around the turn guides 22, so that the processed film sheet 32 is delivered through the opening 40 in the housing 38, as can be seen from FIG. 4. In order to assure that the processed film sheet 32 is completely dry, the drier 36 may be provided to direct a stream of warm air onto the film sheet 32 as it emerges from between the carrier webs 10.

Figure 5:
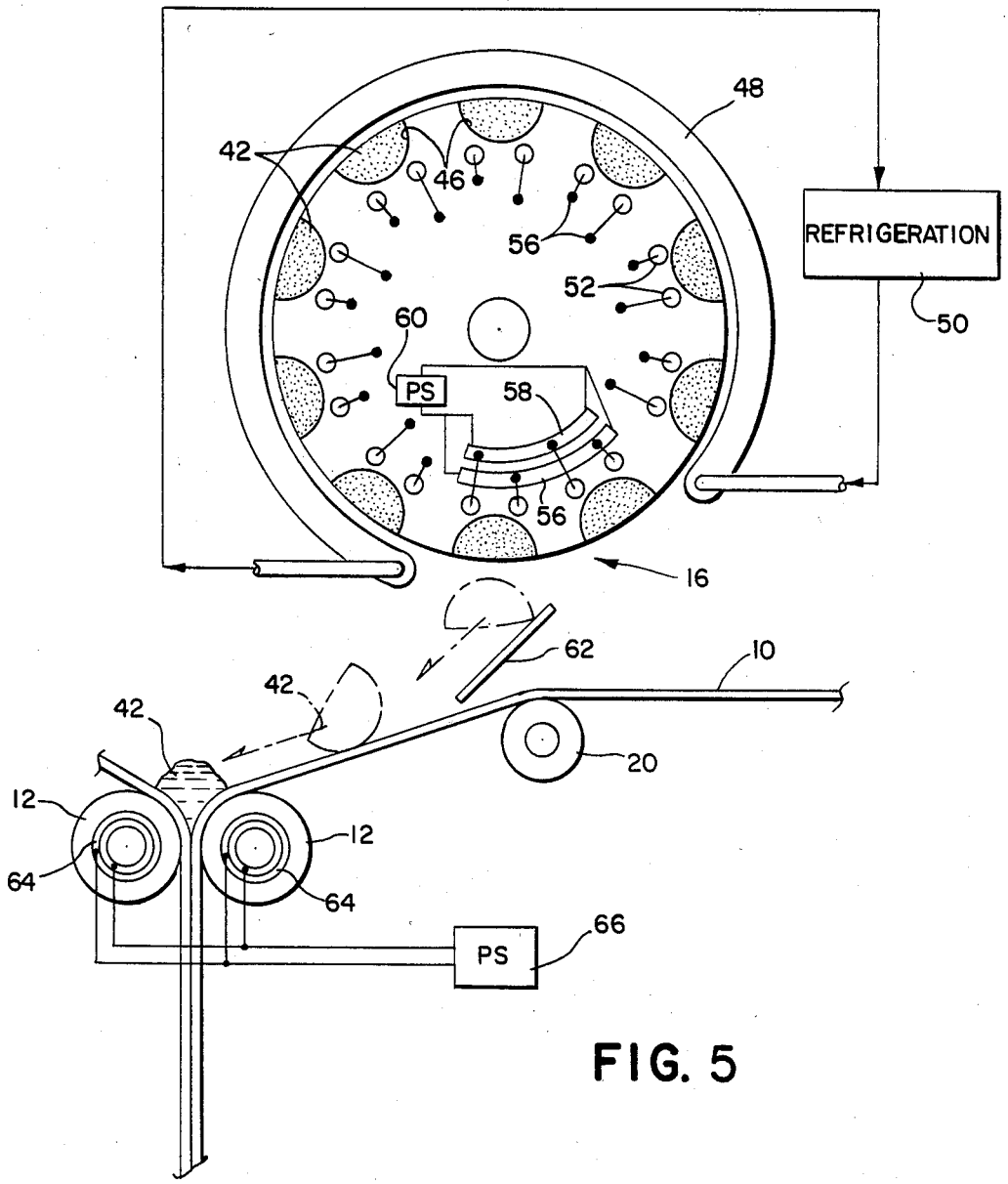
FIG. 5 is an enlarged schematic front view of a preferred processing chemical dispenser for use in the apparatus according to the present invention.

As can best be seen from FIG. 5, the dispenser 16, in its preferred form, comprises a magazine in the shape of a rotor 44 having a plurality of equally spaced peripheral recesses 46, each recess 46 containing the processing chemical 42 frozen in a predetermined form. In the embodiment illustrated, the frozen form is a rodlike body. A refrigerated cowl 48 connected to a refrigeration system 50 is provided around the rotor 44 to maintain the bodies of processing chemical 42 frozen so that they are retained in the recesses 46. A device for controllably releasing the frozen bodies from the rotor 44 is provided. The releasing device can be a plurality of electrical heating elements 52 mounted adjacent the recesses 46 in the rotor 44. A pair of connected heating elements 52 is associated with each recess 46 and is provided with a single pair of leads 54. The leads 54 engage stationary electrical contactors 56 and 58 when the leads 54 move through a predetermined portion of the rotation of the rotor 44. Since the electrical contactors 56 and 58 are connected to a power source 60, current flows through the contacting leads 54 and the associated heating elements 52. The heating elements 52 heat their associated recess 46 and soften the surface of the frozen body, so that the body falls onto a deflector 62 and one of the carrier webs 10 and moves into the area adjacent the nip. Electrical heaters 64 powered by a power source 66 are provided in the pinch rollers 12 to melt the frozen bodies.

It will be appreciated and is contemplated that modifications and/or changes may be made in the embodiments illustrated and described herein without departure from the invention. Accordingly, it is expressly intended that the foregoing description is illustrative only of preferred embodiments, not limiting, and that the true spirit and scope of the present invention be determined by reference to the appended claims.

We claim:

1. Apparatus for simultaneously processing both sides of a film sheet of given length, comprising:

a pair of carrier webs;

means for defining a nip through the carrier webs pass in facing relation;

means for dispensing processing material onto the facing surfaces of the carrier webs in the nip; and advancing means for advancing the carrier webs in one direction to an through the nip to bring the facing surfaces of the webs together at the nip and the spread processing material over a length of the webs at least equal to the given length of the film sheet, for then advancing the webs in the opposite direction back through the nip to retract and separate the lengths of the webs carrying processing material, and for then feeding the film sheet between the webs and again advancing the webs in the one direction through the nip to sandwich the film sheet within the length of the webs carrying processing material.

2. The apparatus of claim 1, wherein the carrier webs are wider than the film sheet to be processed.

3. The apparatus of claim 1 including a pair of turn guides spaced from the nip, in the one direction of advancement, a distance exceeding the given length of the film sheet thereby defining a run of the carrier webs which defines a sandwich for the film sheet.

4. The apparatus of claim 3 including means for defining a processing gap through which the carrier webs extend, the processing gap being spaced from the nip in the one direction of advancement of the webs, and said turn guides are spaced from the processing gap a distance at least equal to the given length of the film sheet.

5. The apparatus of claim 4, wherein the carrier webs extend through the nip and the gap in a vertical orientation.

6. A method for simultaneously processing both sides of a film sheet, comprising:

extending a pair of carrier webs through a nip so that one surface of each web faces a corresponding surface of the other web;

applying processing material to at least one of the facing surfaces;

advancing the facing surfaces through the nip to spread the processing material on both of the facing surfaces;

bringing the areas of the carrier webs on which the processing material has been spread into contact with the film sheet to define a sandwich;

holding the film sheet between the carrier webs for a suitable imbibition time; and delivering the film sheet from between the carrier webs.

7. The method of claim 6, wherein said step of bringing the carrier webs into contact with the film sheet to define a sandwich, comprises the step of retracting the facing surfaces through the nip, separating the surfaces on which the processing material is spread and again advancing the facing surfaces through the nip with the film sheet interposed therebetween.

8. The method of claim 6, wherein the step of advancing the facing webs comprises spreading the processing material over an area of each web greater than the area of one side of the film sheet.

9. The method of claim 6, further comprising, prior to the step of applying processing material to a surface of each web:

providing the processing material in a frozen form; and melting the frozen form.

10. The method of claim 9 wherein the step of providing the processing material in a frozen form comprises;

retaining the processing material in a frozen form in a dispenser, and releasing the frozen form from the dispenser.

11. The method of claim 6, wherein the step of bringing the areas of the carrier webs on which the processing material has been spread into contact with the film sheet includes moving the carrier webs, with the film sheet therebetween, through a gap of predetermined dimension.

12. The method of claim 6, further comprising drying the film sheet delivered from between the carrier webs.

13. The method of claim 6, further comprising absorbing excess processing material.

* * * * *